US008440307B2

(12) United States Patent
Nose et al.

(10) Patent No.: US 8,440,307 B2
(45) Date of Patent: May 14, 2013

(54) CHARGING MEMBER AND METHOD FOR PRODUCING CHARGING MEMBER

(75) Inventors: Keiji Nose, Suntou-gun (JP); Masaaki Harada, Yokohama (JP); Hiroaki Watanabe, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/323,778

(22) Filed: Dec. 12, 2011

(65) Prior Publication Data

US 2012/0082852 A1 Apr. 5, 2012

Related U.S. Application Data

(63) Continuation of application No. PCT/JP2011/004736, filed on Aug. 25, 2011.

(30) Foreign Application Priority Data

Sep. 3, 2010 (JP) ..... 2010-197974

(51) Int. Cl.
*B32B 27/00* (2006.01)
*B05D 5/12* (2006.01)

(52) U.S. Cl.
USPC ..... 428/421; 427/58; 427/372.2; 427/385.5; 427/393.5; 427/487; 427/508; 427/520

(58) Field of Classification Search ..... None
See application file for complete search history.

(56) References Cited

U.S. PATENT DOCUMENTS 4,739,103 A * 4/1988 Hansen et al. ..... 560/125
6,090,492 A 7/2000 Tsuchiya et al.

(Continued)

FOREIGN PATENT DOCUMENTS

JP 7-228820 A 8/1995
JP 10-268613 A 10/1998
JP 11-38751 A 2/1999
JP 11-52103 A 2/1999
JP 2004-238487 A 8/2004
JP 2005352169 A * 12/2005

OTHER PUBLICATIONS

Sato, et al., U.S. Appl. No. 13/308,485, filed Nov. 30, 2011.

(Continued)

*Primary Examiner* — Monique Jackson
(74) *Attorney, Agent, or Firm* — Fitzpatrick, Cella, Harper & Scinto

(57) ABSTRACT

Provided is a charging member in which the hardness of its surface is increased while surface free energy is kept low, the surface is hard to scratch even in long-term use, and a toner or the like is hard to adhere to the surface. The charging member according to the present invention includes a conductive support, a conductive elastic layer, and a surface region containing a cured material of a compound represented by the following formula (1):

wherein n represents an integer of 0-6, m represents an integer of 0-6, the total of n and m is from 2 to 6, x and y each independently represent an integer of 0-4, and $R_1$ and $R_2$ each independently represent a hydrogen atom or a methyl group.

5 Claims, 2 Drawing Sheets

U.S. PATENT DOCUMENTS

| | | | |
|---|---|---|---|
| 6,129,980 | A | 10/2000 | Tsukada et al. |
| 7,486,911 | B2 | 2/2009 | Harada |
| 2008/0292366 | A1 | 11/2008 | Akama et al. |
| 2011/0176833 | A1 | 7/2011 | Harada et al. |
| 2012/0045250 | A1 | 2/2012 | Harada et al. |

OTHER PUBLICATIONS

Watanabe, et al., U.S. Appl. No. 13/416,901, filed Mar. 9, 2012.
Watanabe, et al., U.S. Appl. No. 13/372,454, filed Feb. 13, 2012.

* cited by examiner

CHARGING MEMBER AND METHOD FOR PRODUCING CHARGING MEMBER

CROSS-REFERENCE TO RELATED APPLICATIONS

This application is a continuation of International Application No. PCT/JP2011/004736, filed Aug. 25, 2011, which claims the benefit of Japanese Patent Application No. 2010-197974, filed Sep. 3, 2010.

BACKGROUND OF THE INVENTION

1. Field of the Invention

The present invention relates to a conductive charging member used for a process cartridge and an electrophotographic apparatus and a method for producing a charging member.

2. Description of the Related Art

Japanese Patent Application Laid-Open No. 2005-352169 discloses a charging member used in a contact charging method, including a coating layer comprising a resin and formed by curing a fluorine-containing poly(meth)acrylate resin or a fluorine-containing polyolefin resin with an electron beam.

SUMMARY OF THE INVENTION

The present inventors examined the charging member according to Japanese Patent Application Laid-Open No. 2005-352169, and found out that by long-term use, the surface of the charging member is scratched by friction between the charging member and the photoreceptor, and the scratches may cause defects in an image. In view of this, the present invention is directed to provide a charging member in which the hardness of its surface is increased while surface free energy is kept low, the surface is hard to scratch even in long-term use, and a toner or the like is hard to adhere to the surface, and a method for producing the same.

Solution to Problem

According to one aspect of the present invention provides a charging member including a conductive support, a conductive elastic layer, and a surface region containing a cured material of a compound represented by the following formula (1):

Formula (1)

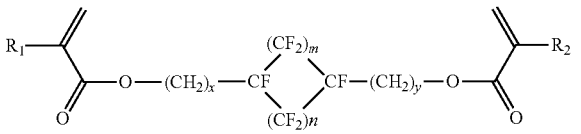

wherein n represents an integer of 0-6, m represents an integer of 0-6, the total of n and m is from 2 to 6, x and y each independently represent an integer of 0-4, and $R_1$ and $R_2$ each independently represent a hydrogen atom or methyl group. The present invention also provides a method for producing a charging member, which method includes the steps of:

(1) obtaining a mixture of a compound represented by the following formula (1) and a binder polymer;

(2) forming a layer of the mixture on a conductive support;

(3) bleeding the compound represented by the formula (1) in the layer of the mixture to localize the compound represented by the formula (1) on a surface of the layer of the mixture; and (4) curing the compound represented by the formula (1) thus localized on the surface of the layer of the mixture, so as to form a surface layer:

Formula (1)

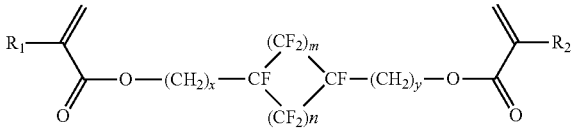

wherein n represents an integer of 0-6, m represents an integer of 0-6, the total of n and m is from 2 to 6, x and y each independently represent an integer of 0-4, and $R_1$ and $R_2$ each independently represent hydrogen atom or methyl group.

Advantageous Effects of Invention

According to the present invention, a charging member having a low surface free energy and a high hardness of a surface can be obtained. According to the present invention, an electrophotographic apparatus that can form an electrophotographic image with high quality can also be obtained.

Further features of the present invention will become apparent from the following description of exemplary embodiments with reference to the attached drawings.

DESCRIPTION OF THE EMBODIMENTS

The charging member according to the present invention has a low surface free energy and a high surface hardness. For this reason, even if the charging member is used for a long period of time, adhesion of a toner and an external additive to the surface thereof can be suppressed, and scratches on the surface can be suppressed.

<Charging Member>

Figure 2:
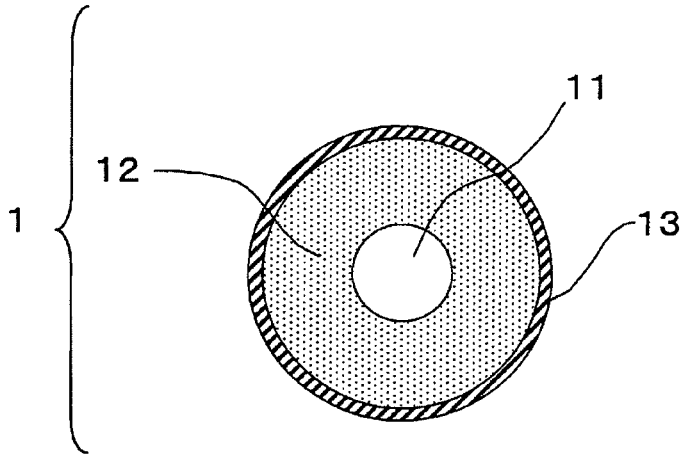
FIG. 2 is a sectional view of an example of the charging member according to the present invention in the direction perpendicular to the axial direction.

A charging member according to the present invention includes a conductive support, an conductive elastic layer provided on the outside of the conductive support, and a surface layer provided on the outside of the conductive elastic layer. FIG. 2 is a sectional view in a direction perpendicular to the axis of a roller-shaped charging member according to the present invention (hereinafter, referred to as a "charging roller"). The charging roller 1 includes a conductive support 11, a conductive elastic layer 12 provided on the outer periphery of the conductive support 11, and a surface region 13 provided on the outer periphery of the conductive elastic layer 12. The elastic layer may be formed of a plurality of layers. However, it is preferable that the conductive elastic layer be a single layer from the viewpoint of productivity.

<Conductive Elastic Layer>

The conductive elastic layer is formed using an unvulcanized rubber mixture for forming an elastic layer prepared by adding (dispersing) necessary additives such as a conductive particle in a binder polymer described later. The conductive elastic layer can be a vulcanized product (cured material) of the unvulcanized rubber mixture for forming an elastic layer. The conductive elastic layer may contain a cured material of a compound represented by the above formula (1) (fluorine-substituted saturated alicyclic group-containing (meth)acrylate ester).

(Binder Polymer)

As the binder polymer that is a main material to form the conductive elastic layer, a material exhibiting rubber elasticity at a temperature in a range where the charging member is practically used can be used as appropriate. Specific examples of the binder polymer include: natural rubbers (NR), isoprene rubbers (IR), butadiene rubbers (BR), styrene-butadiene (SBR), butyl rubbers (IIR), ethylene-propylene-diene terpolymer rubbers (EPDM), epichlorohydrin homopolymers (CHC), epichlorohydrin-ethylene oxide copolymers (CHR), epichlorohydrin-ethylene oxide-allyl glycidyl ether tercopolymers (CHR-AGE), acrylonitrile-butadiene copolymers (NBR), hydrogenated products of acrylonitrile-butadiene copolymers (H-NBR), chloroprene rubbers (CR), and acrylic rubbers (ACM, ANM). Examples thereof also include thermoplastic elastomers such as polyolefin thermoplastic elastomers, polystyrene thermoplastic elastomers, polyester thermoplastic elastomers, polyurethane thermoplastic elastomers, polyamide thermoplastic elastomers, and vinyl chloride thermoplastic elastomers. As the binder polymer, these may be used solely, or two or more thereof may be blended and used. The binder polymer may be a binder polymer vulcanized (cured) by using a vulcanizer or an electron beam according to the properties of the binder polymer as appropriate.

(Conductive Agent)

Preferably, the elastic layer contains a conductive agent in order to adjust the electric resistance. Specific examples of the conductive agent include:

carbon materials such as carbon black and graphite;

oxides such as titanium oxide and tin oxide;

metals such as Cu and Ag; electron conductive agents such as conductive particles obtained by coating surfaces of particles with an oxide or a metal to give conductivity, and inorganic ion substances such as lithium per chlorate, sodium perchlorate, and calcium perchlorate;

cationic surface active agents such as lauryl trimethyl ammonium chloride, stearyl trimethyl ammonium chloride, octadecyl trimethyl ammonium chloride, dodecyl trimethyl ammonium chloride, hexadecyl trimethyl ammonium chloride, trioctyl propyl ammonium bromide, and modified aliphatic dimethylethyl ammonium ethosulfate;

amphoteric surface active agents such as lauryl betaine, stearyl betaine, dimethyl alkyl lauryl betaine;

quaternary ammonium salts such as tetraethylammonium perchlorate, tetrabutylammonium perchlorate, and trimethyloctadecylammonium perchlorate; and organic acid lithium salts such as lithium trifluoromethanesulfonate.

Further, the elastic layer can contain a filler, a processing aid, a crosslinking aid, a crosslinking accelerator, a crosslinking accelerating aid, a crosslinking delaying agent, and a dispersant, which generally used as compounding agents for rubber, as required.

Examples of a method for mixing these raw materials can include a method for mixing using a sealed mixer such as a Banbury mixer or a pressure kneader, and a method for mixing using an open mixer such as an open roll mill.

The conductive elastic layer can be formed by the methods (A) and (B) below:

(A) a method in which an unvulcanized rubber mixture for forming an elastic layer is extruded and molded into a tube shape by an extruder; the obtained tube-like product is vulcanized and molded by a vulcanizer, and a conductive support is pressed into the tube-like product; and the surface of the tube-like product is polished into a desired outer diameter, and (B) a method in which an unvulcanized rubber mixture for forming an elastic layer is co-extruded into a cylindrical shape around a conductive support by an extruder equipped with a crosshead; the obtained product is fixed in a metal mold having a desired outer diameter and vulcanized, so as to obtain a molded product.

Among these, the method (B) is more preferable because continuous production is easily performed and the number of production steps is small, which is suitable for production at low cost.

The surface of the rubber roller thus formed is subjected to a polishing process, so that the roller can be shaped more accurately. Examples of a method for polishing the surface of the roller include a traverse polishing method of polishing by moving a grinding wheel or a roller in a thrust direction of the roller, and a plunge cut polishing method of cutting off the surface of a roller by a polishing grinding wheel having a lager width of the length of the roller without reciprocating the polishing grinding wheel while rotating the roller around a core metal axis. The plunge cut cylindrical polishing method is more preferable because the whole width of an elastic roller can be polished one time, and its processing time is shorter than that in the traverse cylindrical polishing method.

<Surface Region>

The surface region 13 according to the present invention includes not only a surface layer having a clear interface between the conductive elastic layer and the surface layer, but also a surface layer having no clear interface between the conductive elastic layer and the surface layer, and a region on the side of the surface of the charging member in which a larger amount of the cured material of a monomer represented by the following formula (1) exists. The surface region according to the present invention contains a cured material of fluorine-substituted saturated alicyclic group-containing (meth)acrylate ester represented by the following formula (1). The surface region according to the present invention also can contain a compounding agent such as a vulcanizing agent and a vulcanizing aid when necessary. If the cured material of fluorine-substituted saturated alicyclic group-containing (meth)acrylate ester represented by the formula (1) in the surface region is contained in a larger proportion, the effect of the present invention is demonstrated more significantly. Accordingly, a larger proportion of the cured material to be contained is preferable. The cured material of fluorine-substituted saturated alicyclic group-containing (meth)acrylate ester represented by the formula (1) refers to a reacted (cured) product of the compound represented by the formula (1). Examples of the curing method can include heating, irradiation with ultraviolet rays, and irradiation with an electron beam.

Formula (1)

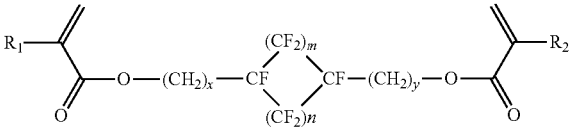

wherein n represents an integer of 0-6, m represents an integer of 0-6, the total of n and m is from 2 to 6, x and y each independently represent an integer of 0-4, and $R_1$ and $R_2$ each independently represent a hydrogen atom or methyl group.

In the formula (1), the compound in which (n+m), which is a total of n and m, is 1 is unstable, hard to synthesize, and easy to pyrolyze. On the other hand, the compound in which n+m is not less than 7 includes molecular chains that relatively freely rotate in a portion of the fluorine-substituted saturated alicyclic structure in the structure. For this reason, rigidity of the cured material is reduced, which leads to a reduction in the hardness of the surface and wear resistance. In the case where at least one of x and y is not less than 5, the proportion of the fluorine content in the compound represented by the formula (1) is reduced. If the compound is used for the surface layer, the surface free energy in the surface of the charging roller is increased, and the effect of preventing adhesion of an external additive is reduced. For this reason, x and y in the present invention each are an integer of not less than 0 and not more than 4. It is preferable that the values of x and y be each smaller in the range because the surface free energy in the charging member can be smaller. The compound in which both x and y are 1 is more preferable because a distance between an acrylate group and an alicyclic group is increased to reduce an influence of steric hindrance of the alicyclic group, and to increase the reactivity compared to the compound in which both x and y are 0. Particularly, compounds represented by the following formulas (2), (3), and (4), which are compounds of the formula (1) in which the total of n and m is 4, and x and y are each 1, are more preferable because of the following reasons. Namely, the compounds represented by the following formulas (2) to (4) have a perfluorocyclohexane structure of an alicyclic group having 6 carbon atoms, and have particularly high stability. The stability of the compound is high because a cyclohexyl group has 6 carbon atoms and has a smaller strain of a carbon-carbon bond angle than a cycloalkane group in which the number of carbon atoms is other than 6.

Formula (2)

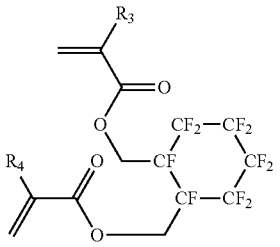

wherein $R_3$ and $R_4$ each independently represent a hydrogen atom or a methyl group.

Formula (3)

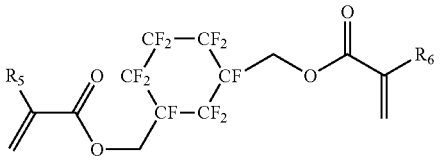

wherein $R_5$ and $R_6$ each independently represent a hydrogen atom or a methyl group.

Formula (4)

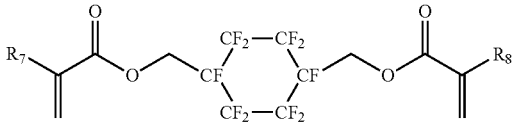

wherein $R_7$ and $R_8$ each independently represent a hydrogen atom or a methyl group.

Examples of a method for obtaining fluorine-substituted alicyclic group-containing (meth)acrylate ester represented by the formula (1) include a method for dehydration condensing fluorine-substituted alicyclic group-containing polyol and (meth)acrylic acid in the presence of an acid catalyst to make an esterification reaction. At this time, the fluorine-substituted alicyclic group-containing polyol to be used can be obtained by reacting a fluorinating agent with alicyclic polyol, or by reacting an alicyclic compound with a fluorinating agent and properly performing oxidation or reduction. In the case where the compound represented by the formula (1) is perfluoro(cyclohexane)-1,2-dimethanol diacrylate, phthalic anhydride is fluorinated, reduced by lithium aluminum hydride, and esterified with an acrylic acid to obtain the compound.

Examples of a method for forming a surface region according to the present invention include the following method. Namely, a solution prepared by dissolving or dispersing a material represented by the formula (1) in a solvent is applied onto the surface of the conductive elastic layer by a known coating method such as dipping, ring coating, beam coating, roll coating, and spraying. Subsequently, the solution is polymerized and cured by heating, or cured by irradiation with ultraviolet rays or an electron beam.

The surface region according to the present invention can be formed by the following method. Namely, first, the material represented by the formula (1) is mixed with the unvulcanized rubber mixture for forming an elastic layer in advance to obtain a mixture. A layer of this mixture is formed on the conductive support, and the material represented by the formula (1) in the layer of the mixture is bled to be localized on a surface of the layer of the mixture. Subsequently, the bleeding material represented by the formula (1) is cured to form a surface region (hereinafter, referred to a "bleeding method").

The surface region obtained by the latter method has higher adhesion to the conductive elastic layer than the surface region obtained by the former method. Additionally, a uniform thickness of the surface region is obtained because no coating step is included. For this reason, the latter method is a more preferable production method.

Accordingly, hereinafter, a method for producing a charging member according to the present invention comprising a step of forming a surface region by the bleeding method will be described in detail. Namely, the method for producing a charging member according to the present invention comprises the steps of (C) to (F) below:

(C) a step of obtaining a rubber mixture of fluorine-substituted saturated alicyclic group-containing (meth)acrylate ester represented by the formula (1) and a binder polymer;

(D) a step of forming a layer of the rubber mixture on the conductive support;

(E) a bleeding step of bleeding fluorine-substituted saturated alicyclic group-containing (meth)acrylate ester represented by the formula (1) in the layer of the rubber mixture to localize the fluorine-substituted saturated alicyclic group-containing (meth)acrylate ester on the surface of the layer of the mixture; and (F) a step of reacting the fluorine-substituted saturated alicyclic group-containing (meth)acrylate ester represented by the formula (1) thus localized on the surface of the layer of the mixture, so as to form a surface layer.

The rubber mixture can be obtained by mixing the compound represented by the formula (1) with the binder polymer, and additives such as conductive particles when necessary. According to the binder polymer in the rubber mixture, a step of vulcanizing the binder polymer in the layer of the rubber mixture is provided between the step (D) and the step (E). In the case where the conductive elastic layer is formed with a plurality of layers, the compound represented by the formula (1) can be mixed with the outermost conductive elastic layer and bled to form a surface layer.

Examples of a method for reacting the compound represented by the formula (1) thus localized on the surface of the layer of the rubber mixture include the following methods. Namely, examples thereof can include heating, irradiation with ultraviolet rays, and irradiation with an electron beam. The reaction at this time can be a curing reaction of fluorine-substituted saturated alicyclic group-containing (meth)acrylate ester. The (meth)acrylate ester group is crosslinked by heating, irradiation with ultraviolet rays, and irradiation with an electron beam. Accordingly, the (meth)acrylate ester group can be cured.

By the method below, it can be found whether or not the compound represented by the formula (1) is localized on a surface side of the layer of the rubber mixture. Namely, on the surface of the charging member after formation of the surface region, peaks derived from the cured material of the compound represented by the formula (1) are detected by the FT-IR (infrared spectroscopy) attenuated total reflection (ATR method). At this time, the localization on the surface can be found if the ratio of intensity of the peak derived from the cured material of the compound represented by the formula (1) to that of the peak derived from the binder polymer (intensity of the peak derived from the cured material of the compound represented by the formula (1)/intensity of the peak derived from the binder polymer) is larger in the surface than that within the charging member.

In the case where the charging member is formed by the method comprising the bleeding step, the composition of the surface region comprises the cured material of the compound represented by the formula (1). Materials to be blended in the rubber mixture in the bleeding step other than the compound represented by the formula (1) can be bled together with bleeding of the compound represented by the formula (1) to be localized in the surface region substantially similarly to the case where the surface region is formed by a coating method.

The bleeding step is performed, for example, by heating approximately for 10 minutes to 30 minutes at a temperature of from 80° C. to 120° C. after the layer of the mixture is formed. Heating improves mobility of the molecules that form the polymer or the rubber elastic layer, and accelerates the bleeding.

The amount of the compound represented by the formula (1) to be blended in the rubber mixture is preferably from 1 part by mass to 10 parts by mass based on 100 parts by mass of the binder polymer. At an amount of not less than 1 part by mass, an appropriate amount of bleeding can be easily ensured, and an uneven thickness of the surface layer due to a small amount of bleeding can be easily prevented. At an amount of not more than 10 parts by mass, an appropriate amount of bleeding can be easily ensured, and an uneven thickness of the surface layer due to a large amount of bleeding can be easily suppressed.

The compound represented by the formula (1) is properly bled without being cured even in the mixing, forming, and vulcanizing processes. For this reason, the compound represented by the formula (1) is suitable for the method for producing the charging member according to the present invention including the bleeding step. This is attributed to a properly bulky substituent that the compound represented by the formula (1) has. For example, the compound represented by the formula (1) has a perfluorocyclohexane structure, in which a rate of moving between the chains of the polymer that forms the elastic layer is properly slow. Usually, in the bleeding process, in a case where a material which is bled in a large amount even with a small blending amount thereof is used, an uneven thickness of the surface layer may be slightly produced. A charging roller having a surface layer with an uneven thickness causes defects in an image if the charging roller is used in an electrophotographic apparatus. If a portion on the roller which causes the defects in an image is observed by an optical microscope or the like, unevenness in gloss may be found. At the portion in which the unevenness in gloss is found, the cross section of the charging roller is observed by a transmission electron microscope (TEM) or a scanning electron microscope (SEM). Then, an uneven thickness of the surface layer from 0.2 μm to 5 μm is found. Namely, whether or not the defects in an image are attributed to the uneven thickness of the surface layer can be determined by finding whether or not unevenness in gloss can be observed, by an optical microscope or the like, on that portion on the roller which causes the defects in an image.

The compound represented by the formula (1) has two (meth)acrylate groups that are a crosslinkable functional group, and has more crosslinking points than in those having a crosslinkable functional group. Further, the compound represented by the formula (1) has a fluorine-substituted saturated alicyclic group, in which free rotation is more limited than that in the conventional linear perfluoroalkyl group, and a volume occupied by the fluorine-substituted saturated alicyclic group is smaller. For this reason, if the compound represented by the formula (1) is cured, crosslinking is denser to increase the hardness of the surface of the charging member. In view of this, the charging member according to the present invention has high wear resistance. The compound represented by the formula (1) has a large number of fluorine atoms. Accordingly, use of the cured material thereof for the surface layer of the charging member can reduce the surface free energy, and reduce contamination to a toner and an external additive. For this reason, in the charging member according to the present invention, adhesion of a toner and an external additive to the surface of the elastic member can be reduced, high wear resistance can be obtained, and the defects in an image can be sufficiently suppressed for a long period of time.

The method for producing a charging member that is the second invention according to this application can simplify the step of coating the surface layer, and suppress an uneven thickness of the surface layer. Further, a surface layer having high adhesiveness to the elastic layer is obtained. Accordingly, the surface layer does not need to contain a curable resin without fluorine that is conventionally mixed in order to increase the adhesiveness. Moreover, the hardness of the surface can be increased while the surface free energy is kept low.

In the charging roller according to the present invention, other than the elastic layer and the surface layer, a functional layer such as an adhesive layer, a diffusion preventing layer, an undercoat layer, and a primer layer can be provided when necessary.

<Electrophotographic Apparatus>

Figure 1:
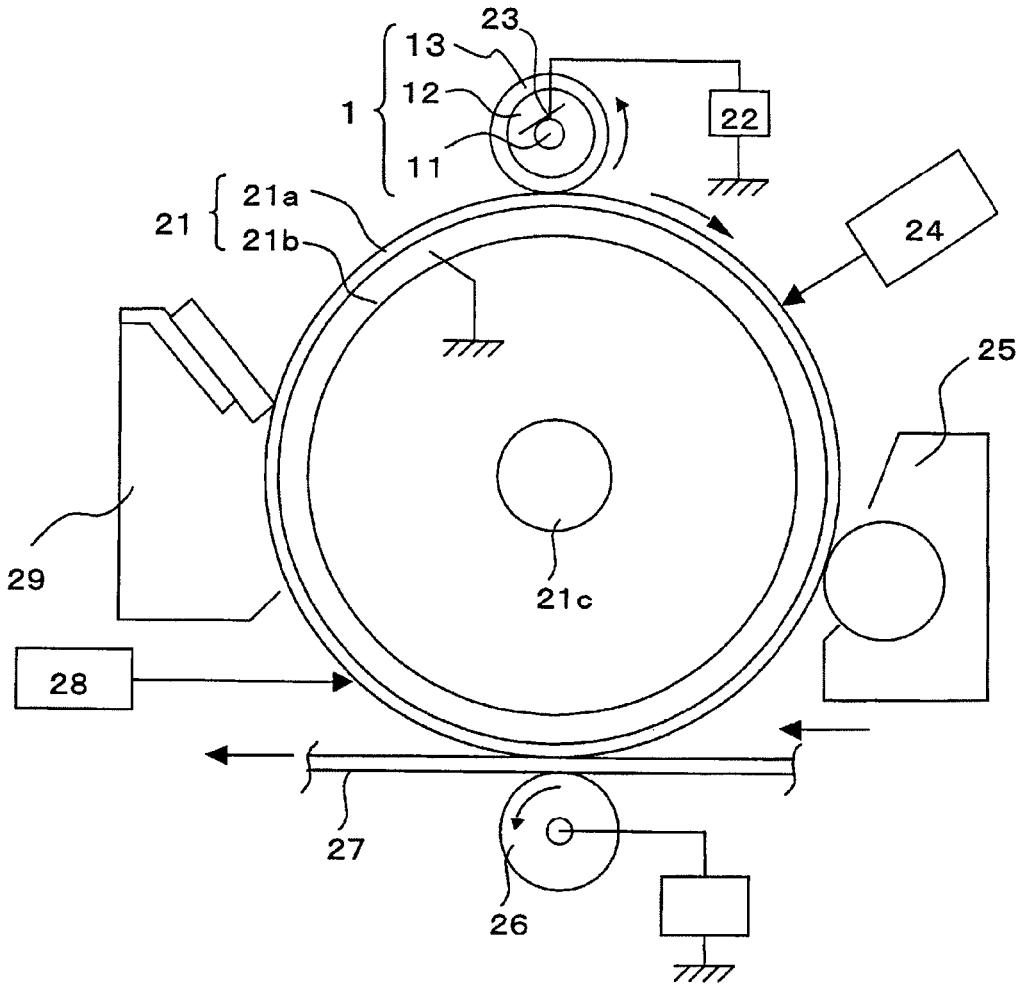
FIG. 1 is a schematic view showing an example of an electrophotographic apparatus using a charging member according to the present invention.

FIG. 1 shows a schematic sectional view of an electrophotographic apparatus according to the present invention. In FIG. 1, an electrophotographic photoreceptor 21 is a charged body. The electrophotographic photoreceptor 21 includes a conductive support 21*b* formed with a material having conductivity such as aluminum, and a photosensitive layer 21*a* formed on the conductive support 21*b*. The electrophotographic photoreceptor 21 has a drum-like shape. The electrophotographic photoreceptor 21 is rotated and driven around a shaft 21*c* clockwise in the drawing at a predetermined circumferential speed.

The charging member according to the present invention is used as a roller-shaped charging member 1 (hereinafter, referred to as a "charging roller") disposed in contact with the electrophotographic photoreceptor 21 to charge the electrophotographic photoreceptor at a predetermined polarity and potential (primary charge). The charging roller 1 is configured such that both ends of the conductive support 11 are pressed against the electrophotographic photoreceptor 21 by a pressing unit not illustrated, and thereby the charging roller 1 can rotate following the electrophotographic photoreceptor 21.

A predetermined direct current (DC) bias is applied to the conductive support 11 by a power supply 22 and a friction power supply 23 to contact charge the electrophotographic photoreceptor 21 at a predetermined polarity and potential. The circumferential surface of the electrophotographic photoreceptor 21 is charged by the charging roller 1. Next, the electrophotographic photoreceptor 21 is subjected to exposure (such as laser beam scanning exposure and slit exposure of an original image) according to information on a target image by an exposing device 24, thereby to form an electrostatic latent image on the circumferential surface of the electrophotographic photoreceptor 21 according to the information on the target image.

Next, the electrostatic latent image is sequentially visualized as a toner image by a developing member 25. Then, by a transfer member 26, the toner image is sequentially transferred onto a transfer material 27, which is conveyed at a proper timing from a sheet feeding unit not illustrated to a transfer section between the electrophotographic photoreceptor 21 and the transfer member 26. The transfer member 26 is a transfer roller, and charges a polarity opposite to that of the toner from the back of the transfer material 27 to transfer the toner image formed on the side of the electrophotographic photoreceptor 21 onto the transfer material 27.

The transfer material 27 having the transferred toner image on the surface thereof is separated from the electrophotographic photoreceptor 21, and conveyed to a fixing unit not illustrated to fix the toner image. Then, the transfer material 27 is output as an image forming product. Alternatively, if an image is formed on the rear surface of the transfer material 27, the transfer material 27 is conveyed again to a re-conveying unit to the transfer section.

The circumferential surface of the electrophotographic photoreceptor 21 after transfer of the image is subjected to pre-exposure by a pre-exposing device 28 to discharge the charge remaining on the drum of the electrophotographic photoreceptor. Adhering and contaminating objects such as a transfer remaining toner are removed from the discharged circumferential surface of the electrophotographic photoreceptor 21 by a cleaning member 29 to clean the circumferential surface of the electrophotographic photoreceptor 21. Thereby, the electrophotographic photoreceptor 21 is repeatedly used for formation of an image.

The charging roller 1 may be driven following the electrophotographic photoreceptor 21 driven to be planarly moved, or may not be rotated. Alternatively, the charging roller 1 may be intendedly rotated and driven in a forward direction or opposite direction to the direction of the moving surface of the electrophotographic photoreceptor 21 at a predetermined circumferential speed.

In the case where the electrophotographic apparatus is used as a copier, exposure may be performed by the light reflected from or transmitted through an original. Alternatively, exposure may be performed by converting the original into a read signal and performing scanning with a laser beam based on the signal, driving an LED array, or driving a liquid crystal shutter array. Examples of the electrophotographic apparatus using the charging member according to the present invention include apparatuses using electrophotography such as copiers, laser beam printers, LED printers, and electrophotographic printing plate making systems.

EXAMPLES

Hereinafter, the present invention will be described more in detail using Examples. Hereinafter, as reagents or the like, commercially available products with high purity were used unless otherwise specified.

(Synthesis of Surface Layer Material)

Hereinafter, synthesis examples of fluorine-substituted saturated alicyclic group-containing (meth)acrylate ester according to the present invention will be shown.

Synthesis Example 1

The materials shown in Table 1 were dissolved in a mixed solvent of 100 ml of toluene and 70 ml of cyclohexane.

TABLE 1

| Materials | Amount to be blended |
|---|---|
| Perfluoro(cyclohexane)-1,2-dimethanol that is fluorine-substituted alicyclic group-containing polyol | 65 g |
| Acrylic Acid | 58 g |
| p-Toluenesulfonic acid | 4.5 g |
| p-Methoxyphenol | 0.2 g |
| Hydroquinone | 50 mg |

While the air was blown into the solution at a flow rate of 60 mL/min, the solution was refluxed for 20 hours and dehydrated to make an esterification reaction. After the reaction was completed, 10% by mass of a sodium hydrogencarbonate aqueous solution was added, and an organic layer was extracted. The organic layer was condensed to obtain perfluoro(cyclohexane)-1,2-dimethanol diacrylate (Compound A). The product was measured by $^1$H NMR, and progression of the synthesis reaction was checked. $^1$H NMR: $\delta(CDCl_3)$ 4.94 (—$CH_2$—, s, 4H), 5.96-6.53 ($CH_2$═CH—, m, 6H) The measurement condition of $^1$H NMR was shown below.

Measurement apparatus, FTNMR apparatus: "JNM-EX400" (trade name, made by JEOL, Ltd.).

Measurement frequency: 400 MHz.

Pulse condition: 5.0 μS.

Data points: 32768.

Frequency range: 10500 Hz.

The number of integration: 16.

Measurement temperature: room temperature.

A sample for measurement was prepared as follows: 50 mg of a sample material was placed into a sample tube having a diameter of 5 mm, and $CDCl_3$(chloroform-d1: containing 0.05% by mass of TMS (tetramethylsilane)) was added as a solvent.

Synthesis Example 2

As fluorine-substituted alicyclic group-containing polyol, 65 g of perfluoro(cyclohexane)-1,2-dimethanol was replaced by 61 g of perfluoro(cyclohexane)-1,2-diethanol. Except that, in the same manner as in Synthesis Example 1, perfluoro (cyclohexane)-1,2-diethanol diacrylate (Compound B) was obtained.

Synthesis Example 3

As fluorine-substituted alicyclic group-containing polyol, 65 g of perfluoro(cyclohexane)-1,2-dimethanol was replaced by 65 g of perfluoro(cyclohexane)-1,3-dimethanol. Except that, in the same manner as in Synthesis Example 1, perfluoro (cyclohexane)-1,3-dimethanol diacrylate (Compound C) was obtained.

Synthesis Example 4

As fluorine-substituted alicyclic group-containing polyol, 65 g of perfluoro(cyclohexane)-1,2-dimethanol was replaced by 65 g of perfluoro(cyclohexane)-1,4-dimethanol. Except that, in the same manner as in Synthesis Example 1, perfluoro (cyclohexane)-1,4-dimethanol diacrylate (Compound D) was obtained. The values of n, m, n+m, x, and y of Compounds A to D according to the compound represented by the formula (1) are shown in Table 2 below.

TABLE 2

| | Compound A | Compound B | Compound C | Compound D |
|---|---|---|---|---|
| n | 4 | 4 | 3 | 2 |
| m | 0 | 0 | 1 | 2 |
| n + m | 4 | 4 | 4 | 4 |
| x | 1 | 2 | 1 | 1 |
| y | 1 | 2 | 1 | 1 |

Hereinafter, production examples of the charging roller according to the present invention will be shown.

Example 1

The materials shown in Table 3 were mixed by a 6-L pressure kneader: "TD6-15 MDX" (trade name, made by Toshin Co., Ltd.) to obtain Unvulcanized Rubber Mixture A. As the mixing condition, the filling rate was 70 vol %, the number of rotation of the blade was 35 rpm, and the mixing time was 16 minutes.

TABLE 3

| Materials | Parts by mass |
|---|---|
| NBR: "JSR N230SV" (trade name, made by JSR Corporation) as binder polymer | 100 |
| Zinc stearate | 1 |
| Zinc oxide | 5 |
| Calcium carbonate: "NANOX #30" (trade name, made by Maruo Calcium Co., Ltd.) | 20 |
| Carbon black as conductive agent: "TOKABLACK #7360SB" (trade name, made by Tokai Carbon Co., Ltd.) | 48 |

Unvulcanized Rubber Mixture A and materials shown in Table 4 below were mixed using an open roll mill having a roll diameter of 12 inches (30.5 cm) to obtain Unvulcanized Rubber Mixture B. As the mixing condition, the number of rotation of the front roll was 10 rpm, the number of rotation of the back roll was 8 rpm, and the gap between the rolls was 2 mm.

TABLE 4

| Materials | Parts by mass |
|---|---|
| Sulfur as crosslinking agent | 1.2 |
| Tetrabenzylthiuram sulfide as vulcanization accelerator: "NOCCELER TBzTD" (trade name, made by Ouchi Shinko Chemical Industrial Co., Ltd.) | 4.5 |

To Unvulcanized Rubber Mixture B, 5 parts by mass of Compound A obtained in Synthesis Example 1 was added, and mixed using an open roll mill to obtain Unvulcanized Rubber Mixture C. The mixing condition was the same as that when Unvulcanized Rubber Mixture A was mixed with sulfur and the vulcanization accelerator.

(Formation of Layer of Mixture)

A conductive vulcanization adhesive: "METALOC U-20" (trade name, made by Toyokagaku Kenkyusho, Co., Ltd.) was applied to a cylindrical surface of a cylindrical conductive support at its central portion with a length of 228 mm in an axial direction of the cylindrical conductive support, and dried at a temperature of 80° C. for 30 minutes. The cylindrical conductive support had a diameter of 6 mm and a length of 252 mm (made by Micron Seiko Co., Ltd., made of steel, nickel-plated surface). Next, Unvulcanized Rubber Mixture C was extruded into a cylindrical shape onto the circumferential surface of the conductive support by using an extruder with a crosshead to produce an unvulcanized rubber roller in which the outer periphery of the conductive support was coated with the layer of Unvulcanized Rubber Mixture C. The extruder used here had a cylinder diameter of 45 mm and L/D=20. The temperature of the crosshead during extrusion was 100° C., the temperature of the cylinder portion was 110° C., and the temperature of the screw was 110° C.

The obtained unvulcanized rubber roller was heated at a temperature of 160° C. for 30 minutes in the air under an atmospheric pressure by a heating furnace. Thereby, the rubber was vulcanized to form a vulcanized rubber layer on the outer periphery of the conductive support. Next, both ends of the vulcanized rubber layer in the transverse direction thereof were cut such that the length of the vulcanized rubber layer in the transverse direction thereof might be 232 mm. Further, the surface of the vulcanized rubber layer was polished by a polisher (trade name: LEO-600-F4-BME, made by Minakuchi Machinery Works Ltd.) to obtain a rubber roller having a crown-shaped vulcanized rubber layer in which the diameter of the end portion was 8.40 mm and the diameter of the central portion was 8.50 mm.

The obtained rubber roller was heated at a temperature of 100° C. for 30 minutes in the air under an atmospheric pressure by a heating furnace to bleed Compound A on the side of the surface of the vulcanized rubber layer.

Next, the surface of the rubber roller was irradiated with an electron beam to cure Compound A. Thus, Charging Roller 1 was obtained. Using an electron beam irradiation apparatus (made by Iwasaki Electric Co., Ltd.) having the maximum accelerating voltage of 150 kV and the maximum electron current of 40 mA, irradiation with an electron beam was performed for 3 seconds at an accelerating voltage of 150 KV and an electron current of 10 mA while the rubber roller was rotated at 500 rpm. During irradiation with an electron beam, the concentration of oxygen around the rubber roller was adjusted to 100 ppm using nitrogen gas.

Next, a method for evaluating a variety of physical properties and performances of the charging roller will be described.

(Check of Surface Layer)

The surface of Charging Roller 1 and the portion 0.5 mm from the surface thereof in the depth direction were subjected to infrared absorption spectrum analysis. In the analysis, an analyzer (trade name: FTIR-8300, made by SHIMADZU Corporation) connected to a microscopy IR (trade name AIM-8000R, made by SHIMADZU Corporation). The analysis was performed by attenuated total reflection (ATR method) using a germanium prism. At this time, the ratio of the intensity of the peak derived from the compound represented by the formula (1) (C═O stretching of 1720 $cm^{-1}$) to that of the peak derived from NBR (C═N stretching of 2237 $cm^{-1}$) (intensity of the peak derived from the surface layer forming material/intensity of the peak derived from NBR) was compared. As a result, the ratio of the intensity was larger in the surface of the charging roller than within the elastic layer. Thus, it was found that a surface region having a localized cured material of the compound represented by the formula (1) was formed.

(Measurement of Hardness of Roller)

The hardness of Charging Roller 1 was measured in an environment at a temperature of 23° C. and a humidity of 55% RH (relative humidity) in a peak hold mode using a micro rubber durometer (trade name: MD-1 capa, made by Kobunshi Keiki Co., Ltd.). More specifically, the charging roller was placed on a metallic plate, and a metallic block was placed to fix the charging roller so as not to roll. A measurement terminal was pressed against the center of the charging member in the direction perpendicular to the metallic plate, and the value was read after 5 seconds. In the same manner, three places in each of the end portions 30 to 40 mm from the rubber end of the charging roller in the axial direction and three places of the central portion in the circumferential direction, nine places in total were measured. The average of the obtained measured values was defined as the hardness of the charging roller. As a result, the hardness of Charging Roller 1 was 79°.

(Measurement of Hardness of Surface)

When load was applied to Charging Roller 1 on the condition below using a surface coating physical property tester (trade name: FISCHERSCOPE H100C, made by Fischer), the maximum hardness at a press depth of an indenter to 5 μm was defined as the hardness of the surface of the charging roller.

$$dF/dt = 1000 \text{ mN}/240 \text{ s},$$

F: force, t: time.

A quadrangular pyramid-shaped diamond was used as the indenter. A metallic block was placed to fix the charging roller so that the charging roller did not roll, and a measurement terminal was perpendicularly pressed against the surface of the charging roller. As a result, the hardness of the surface was 5.7 N/mm$^2$.

(Measurement of Surface Free Energy of Charging Roller ($\gamma^{Total}$))

In order to calculate the surface free energy of the charging roller, first, a contact angle with respect to each of three probe liquids having known three components of the surface free energy shown in Table 5 below was measured by a contact angle meter (trade name: CA-X ROLL type, made by Kyowa Interface Science Co., Ltd.). The measurement condition of the contact angle θ is as follows:

measurement: liquid dropping method (perfect circle fitting).

amount of solution: 1 μl, recognition of droplet: automatic, image processing: algorithm non-reflecting, image mode: frame, threshold level: automatic.

TABLE 5

| | Kitazaki-Hata theory | | | |
|---|---|---|---|---|
| Probe liquid | $\gamma L^d$ | $\gamma L^p$ | $\gamma L^h$ | $\gamma L^{Total}$ |
| Water | 29.1 | 1.3 | 42.4 | 72.8 |
| Diiodomethane | 46.8 | 4.0 | 0.0 | 60.8 |
| Ethylene glycol | 30.1 | 0.0 | 17.6 | 47.7 |

In Table 5, $\gamma L^d$, $\gamma L^p$, and $\gamma L^h$ each represent a dispersion force component, a polar component, and a hydrogen bond component. The surface free energies of the three probe liquids in Table 5 ($\gamma L^d$, $\gamma L^p$, $\gamma L^h$) and the contact angles θ with respect to the probe liquids obtained by the measurement were substituted into the following expression (1), and three equations about the respective probe liquids were created. The linear equations with three variables were solved to calculate $\gamma S^d$, $\gamma S^p$, and $\gamma S^h$. The sum of $\gamma S^d$, $\gamma S^p$, and $\gamma S^h$ was defined as the surface free energy ($\gamma^{Total}$).

$$\sqrt{\gamma L^d \times \gamma S^d} + \sqrt{\gamma L^p \times \gamma S^p} + \sqrt{\gamma L^h \times \gamma S^h} = \frac{\gamma L(1+\cos\theta)}{2} \quad \text{Expression (1)}$$

As a result, the surface free energy of the charging roller 1 was 33 mJ/mm$^2$.

(Evaluation of Image)

The produced charging roller was assembled into an electrophotographic process cartridge. The process cartridge was assembled into an electrophotographic apparatus (trade name: LBP5050, made by Canon Inc.) for longitudinally outputting a paper of an A4 size, and an image was evaluated.

Evaluation of an image was performed under an environment of a temperature 15° C./humidity of 10% RH. Specifically, 3000 sheets of an electrophotographic image were formed on a paper of an A4 size, the electrophotographic image having the alphabet letter "E" at a size of 4 points to be printed such that the coverage might be 1%. Subsequently, a halftone image (image in which a line with a width of 1 dot was drawn at an interval of 2 dots in the direction perpendicular to the rotating direction of the electrophotographic photoreceptor) was formed. The halftone image was visually observed, presence and a degree of striped defects caused by the toner adhering to the charging roller (hereinafter, abbreviated to "evaluation of image (1)") and presence and a degree of striped defects caused by wear of the charging roller (hereinafter, abbreviated to "evaluation of image (2)") each were evaluated on the criterion below.

The evaluation criterion is as follows.

A: no image defect is found.

B: image defects are very slightly produced.

C: image defect are slightly produced.

D: image defect are produced.

In the evaluation of an image, a rank C or above was determined as a level for practical use.

(Defect Rate)

By the method in Example 1, 100 charging rollers were produced. Using each of the charging rollers, an electrophotographic image was formed on a paper of an A4 size, the electrophotographic image having the alphabet letter "E" at a size of 4 points to be printed such that the coverage might be 1%. The number of the charging rollers having defects produced in the image was counted, and the number thereof was defined as the defect rate of the charging roller. A smaller value designates higher production stability. By the method below, it was determined whether the defects produced in the electrophotographic image were attributed to the charging roller. Namely, the surface of a portion of the charging roller corresponding to the portion in which the defects in the electrophotographic image were produced was observed by a video microscope (made by Keyence Corporation, at a magnification of 500 times). In the case where any abnormality such as unevenness in gloss was found in the observed portion, it was determined that the defects in the image were attributed to the charging roller.

Example 2

Charging Roller 2 was produced by the same method as that in Example 1 except that Compound A was replaced by Compound B. For Charging Roller 2 thus obtained, a variety of physical properties was measured in the same manner as in Example 1. The evaluation of an image was performed in the same manner as in Example 1 except that Charging Roller 2 was used. Further, the production stability was evaluated in the same manner as in Example 1.

Example 3

Charging Roller 3 was produced by the same method as that in Example 1 except that the amount of Compound A to be blended was 11 parts by mass. For Charging Roller 3 thus obtained, a variety of physical properties was measured in the same manner as in Example 1. The evaluation of an image was performed in the same manner as in Example 1 except that Charging Roller 3 was used. Further, the production stability was evaluated in the same manner as in Example 1.

Example 4

Charging Roller 4 was produced by the same method as that in Example 1 except that the amount of Compound A to be blended was 10 parts by mass. For Charging Roller 4 thus obtained, a variety of physical properties was measured by the same method as that in Example 1. The evaluation of an image was performed in the same manner as in Example 1 except that Charging Roller 4 was used. Further, the production stability was evaluated in the same manner as in Example 1.

Example 5

Charging Roller 5 was produced by the same method as that in Example 1 except that the amount of Compound A to be blended was 1 part by mass. For Charging Roller 5 thus obtained, a variety of physical properties was measured in the same manner as in Example 1. The evaluation of an image was performed in the same manner as in Example 1 except that Charging Roller 5 was used. Further, the production stability was evaluated in the same manner as in Example 1.

Example 6

Charging Roller 6 was produced by the same method as that in Example 1 except that the amount of Compound A to be blended was 0.5 parts by mass. For Charging Roller 6 thus obtained, a variety of physical properties was measured in the same manner as in Example 1. The evaluation of an image was performed in the same manner as in Example 1 except that Charging Roller 6 was used. Further, the production stability was evaluated in the same manner as in Example 1.

Example 7

Charging Roller 7 was produced by the same method as that in Example 1 except that Compound A was replaced by Compound C. For Charging Roller 7 thus obtained, a variety of physical properties was measured in the same manner as in Example 1. The evaluation of an image was performed in the same manner as in Example 1 except that Charging Roller 7 was used. Further, the production stability was evaluated in the same manner as in Example 1.

Example 8

Charging Roller 8 was produced by the same method as that in Example 1 except that Compound A was replaced by Compound D. For Charging Roller 8 thus obtained, a variety of physical properties was measured in the same manner as in Example 1. The evaluation of an image was performed in the same manner as in Example 1 except that Charging Roller 8 was used. Further, the production stability was evaluated in the same manner as in Example 1.

Example 9

Charging Roller 9 was produced by the same method as that in Example 1 except that the binder polymer was replaced by 100 parts by mass of SBR (trade name: JSR 1507, made by JSR Corporation). For Charging Roller 9 thus obtained, a variety of physical properties was measured in the same manner as in Example 1. The evaluation of an image was performed in the same manner as in Example 1 except that Charging Roller 9 was used. Further, the production stability was evaluated in the same manner as in Example 1.

Example 10

Charging Roller 10 was produced in the same manner as in Example 1 except that the amount of Compound A was 3 parts by mass, and 2 parts by mass of Compound B was added. For Charging Roller 10 thus obtained, a variety of physical properties was measured in the same manner as in Example 1. The evaluation of an image was performed in the same manner as in Example 1 except that Charging Roller 10 was used. Further, the production stability was evaluated in the same manner as in Example 1.

Comparative Example 1

Charging Roller 12 was produced by the same method as that in Example 1 except that Compound A was replaced by (perfluorooctyl)ethyl acrylate (trade name: Light Acrylate FA-108, made by Kyoeisha Chemical Co., Ltd.). For Charging Roller 12 thus obtained, a variety of physical properties was measured in the same manner as in Example 1. The evaluation of an image was performed in the same manner as in Example 1 except that Charging Roller 12 was used. Further, the production stability was evaluated in the same manner as in Example 1.

Example 11

Charging Roller 13 was produced by the same method as that in Example 1 except that Compound A was replaced by (perfluorocyclohexyl)methyl acrylate. For Charging Roller 13 thus obtained, a variety of physical properties was measured in the same manner as in Example 1. The evaluation of an image was performed in the same manner as in Example 1 except that Charging Roller 13 was used. Further, the production stability was evaluated in the same manner as in Example 1.

The results of the evaluation of the physical properties, image, and production stability in the charging rollers according to Examples 1 to 10 and Comparative Examples 1 and 2 are shown in Table 11 below. Unlike Example 1, in Comparative Example 1, a cured material of acrylic acid ester having no fluorine-substituted alicyclic group was used as the bleeding material, and the evaluation rank of the image was reduced due to stripes caused by wear. Moreover, the amount of (perfluorooctyl)ethyl acrylate to be bled from the layer of the mixture to the surface is larger than that of the compound represented by the formula (1). For this reason, the larger number of defects was produced than in Example 1.

Moreover, unlike Example 1, in Comparative Example 2, a cured material of fluorine alicyclic group-containing acrylic acid ester having one acrylic group (it is not the compound represented by the formula (1)) was used as the bleeding material, and the evaluation rank of the image was reduced due to stripes caused by wear. Moreover, the amount of (perfluorocyclohexyl)methyl acrylate to be bled from the layer of the mixture to the surface is larger than that of the compound represented by the formula (1). For this reason, the larger number of defects was produced than in Example 1.

Example 11

In the charging roller according to the present Example, a coating film containing fluorine-substituted saturated alicyclic group-containing (meth)acrylate ester was formed on the surface of the conductive elastic layer, and the coating film was irradiated with an electron beam to form a surface region. Hereinafter, a method for producing the charging roller according to the present Example will be described.

(Preparation of Unvulcanized Rubber Mixture for Forming Elastic Layer)

The materials shown in Table 6 were mixed by a 6-L pressure kneader: "TD6-15 MDX" (trade name, made by Toshin Co., Ltd.).

TABLE 6

| Materials | Parts by mass |
|---|---|
| NBR: "JSR N230SV" (trade name, made by JSR Corporation) as binder polymer | 100 |
| Zinc stearate | 1 |
| Zinc oxide | 5 |
| Calcium carbonate: "NANOX #30" (trade name, made by Maruo Calcium Co., Ltd.) | 20 |
| Carbon black as conductive agent: "TOKABLACK #7360SB" (trade name, made by Tokai Carbon Co., Ltd.) | 48 |

As the mixing condition, the filling rate was 70 vol %, and the number of rotation of the blade was 35 rpm, and by mixing for 16 minutes, a kneaded rubber composition for forming an elastic layer A was obtained. The kneaded rubber composition A and the materials shown in Table 7 were mixed by an open roll mill having a roll diameter of 12 inches at the number of rotation of the front roll of 10 rpm, the number of rotation of the back roll of 8 rpm, and a gap between the rolls of 2 mm, thereby to obtain an unvulcanized rubber mixture for forming an elastic layer.

TABLE 7

| Materials | Parts by mass |
|---|---|
| Sulfur as crosslinking agent | 1.2 |
| Tetrabenzylthiuram sulfide as vulcanization accelerator: "NOCCELER TBzTD" (trade name, made by Ouchi Shinko Chemical Industrial Co., Ltd.) | 4.5 |

(Formation of Elastic Layer)

Using the unvulcanized rubber mixture for forming an elastic layer, a rubber roller having an elastic layer was obtained in the same manner as in Example 1.

(Preparation of Coating Solution for Forming Surface Layer)

The materials for forming a surface layer shown in Table 8 were placed in a beaker, and mixed by a stirring bar to obtain a coating solution.

TABLE 8

| Materials | Parts by mass |
|---|---|
| Perfluoro(cyclohexane)-1,2-dimethanoldiacrylate (Compound A) | 10 |
| Methyl ethyl ketone as solvent | 90 |

The coating solution was placed in a sealable container. The sealable container was connected to a syringe pump as a solution feeding unit. Further, a solution feeding port included in a ring head was connected, and an appropriate amount of the coating solution was fed into the ring head. The coating solution was filled into the ring head having a solution distribution chamber for merging the coating solution within the ring head and distributing it in the circumferential direction. The obtained rubber roller having an elastic layer was vertically supported, and the ring head was disposed such that a slit-like eject port opened in the whole circumference of the ring head might be located 0.5 mm spaced from the outer diameter of the rubber roller. At this time of use, the opening width (slit width) of the slit-like eject port opened in the whole circumference of the ring head was 0.1 mm. The ring head was vertically moved from the upper end of the rubber roller to the lower end thereof at a constant speed of 50 mm/s, and simultaneously an appropriate amount (0.07 mL) of the coating solution for forming the topmost surface layer was uniformly applied to the whole circumference of the rubber roller at an eject rate of 0.013 mL/s. Subsequently, methyl ethyl ketone added as the solvent was dried at room temperature in the air. Thus, the coating film of the coating solution was formed.

Next, the coating film was irradiated with an electron beam in the same manner as in Example 1 to cure the coating film. Thus, Charging Roller 11 was obtained. In Charging Roller 11, a variety of physical properties was measured in the same manner as in Example 1. The evaluation of an image was performed in the same manner as in Example 1 except that Charging Roller 11 was used. Further, the production stability was evaluated in the same manner as in Example 1.

Comparative Example 3

Charging Roller 14 was produced by the same method as in Example 11 except that the blend of the coating solution was replaced by that shown in Table 9. For Charging Roller 14 thus obtained, a variety of physical properties was measured in the same manner as in Example 1. The evaluation of an image was performed in the same manner as in Example 1 except that Charging Roller 14 was used. Further, the production stability was evaluated in the same manner as in Example 1.

TABLE 9

| Materials | Parts by mass |
|---|---|
| (Perfluorooctyl)ethyl acrylate: "Light Acrylate FA-108" (trade name, made by Kyoeisha Chemical Co., Ltd.) | 10 |
| Methyl ethyl ketone | 90 |

The number of defects was larger than that in Comparative Example 1 because the surface layer was separately formed using the coating step instead of the bleeding method.

Comparative Example 4

Charging Roller 15 was produced by the same method as in Example 11 except that the blend of the coating solution was replaced by that shown in Table 10. In the obtained Charging Roller 15, a variety of physical properties was measured in the same manner as in Example 1. The evaluation of an image was performed in the same manner as in Example 1 except that Charging Roller 15 was used. Further, the production stability was evaluated in the same manner as in Example 1.

TABLE 10

| Materials | Parts by mass |
|---|---|
| (Perfluorocyclohexyl)methyl acrylate | 10 |
| Methyl ethyl ketone | 90 |

The number of defects was larger than that in Comparative Example 2 because the surface layer was separately formed using the coating step instead of the bleeding method.

The results in Examples 1 to 10 and Comparative Examples 1 and 2 using the bleeding method in formation of the surface region are shown in Table 11. The results in Example 11 and Comparative Examples 3 and 4 using the coating step for formation of the surface region are shown in Table 12.

TABLE 11

| | Example | | | | | | | | | | Comparative Example | |
|---|---|---|---|---|---|---|---|---|---|---|---|---|
| | 1 | 2 | 3 | 4 | 5 | 6 | 7 | 8 | 9 | 10 | 1 | 2 |
| Hardness of roller (MD-1 hardness) (°) | 79 | 79 | 81 | 80 | 80 | 80 | 79 | 79 | 73 | 79 | 80 | 80 |
| Surface hardness ($N/mm^2$) | 5.7 | 5.5 | 6.2 | 6.0 | 5.1 | 4.8 | 5.6 | 5.5 | 5.2 | 5.6 | 3.8 | 4.3 |
| Surface free energy ($mJ/mm^2$) | 33 | 34 | 30 | 33 | 34 | 40 | 34 | 34 | 33 | 33 | 29 | 33 |
| Evaluation of image (1) | A | A | A | A | A | A | A | A | A | A | A | A |
| Evaluation of image (2) | A | A | A | A | A | A | A | A | A | A | C | B |
| Defect rate (%) | 0 | 0 | 1 | 0 | 0 | 3 | 0 | 0 | 0 | 0 | 6 | 4 |

TABLE 12

| | Example | Comparative Example | |
|---|---|---|---|
| | 11 | 3 | 4 |
| Hardness of roller (MD-1 hardness) (°) | 81 | 81 | 81 |
| Surface hardness ($N/mm^2$) | 6.3 | 4.0 | 4.5 |
| Surface free energy ($mJ/mm^2$) | 30 | 27 | 31 |
| Evaluation of image (1) | A | A | A |
| Evaluation of image (2) | A | C | B |
| Defect rate (%) | 11 | 15 | 12 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2010-197974, filed Sep. 3, 2010, which is incorporated by reference herein as part of this application.

What is claimed is:

1. A charging member comprising a conductive support and a conductive elastic layer, wherein the conductive elastic layer comprises acrylonitrile-butadiene copolymer, and wherein a surface region of the conductive elastic layer comprises a cured material of a compound represented by the following formula (2):

Formula (2)

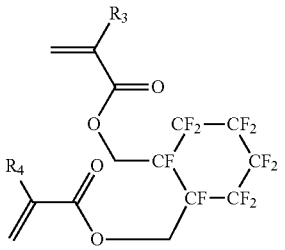

wherein $R_3$ and $R_4$ each independently represent a hydrogen atom or a methyl group.

2. A method for producing a charging member, comprising the steps of:

(1) obtaining a mixture of a compound represented by the following formula (2) and acrylonitrile-butadiene copolymer as a binder polymer;

(2) forming a layer of the mixture on a conductive support;

(3) bleeding the compound represented by the formula (2) on a surface of the layer of the mixture; and (4) curing the compound represented by the formula (2) thus localized on the surface of the layer of the mixture, so as to form a surface layer:

Formula (2)

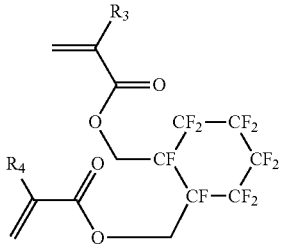

wherein $R_3$ and $R_4$ each independently represent a hydrogen atom or a methyl group.

3. The method according to claim 2, wherein step (3) comprises a step of heating the layer of the mixture for 10 minutes to 30 minutes at a temperature of from 80° C. to 120° C.

4. The method according to claim 2, wherein step (4) comprises a step of irradiating the compound represented by the formula (2) with an ultraviolet ray or an electron beam.

5. The method according to claim 2, wherein step (4) comprises a step of heating the compound represented by the formula (2).

* * * * *